US006173668B1

(12) United States Patent
Kyle

(10) Patent No.: US 6,173,668 B1
(45) Date of Patent: Jan. 16, 2001

(54) FURLING DRUM WITH FIXED GUARD

(75) Inventor: James H. Kyle, Keene, NH (US)

(73) Assignee: Pompanette, Inc., Charles, NH (US)

( * ) Notice: Under 35 U.S.C. 154(b), the term of this patent shall be extended for 0 days.

(21) Appl. No.: 09/272,256

(22) Filed: Mar. 19, 1999

(51) Int. Cl.[7] ..... B63H 9/04
(52) U.S. Cl. ..... 114/104
(58) Field of Search ..... 114/104, 105, 114/106, 107; 254/382, 383; 242/601

(56) References Cited

U.S. PATENT DOCUMENTS

| | | | | |
|---|---|---|---|---|
| 3,958,523 | * | 5/1976 | Holmes et al. | 114/106 |
| 3,980,036 | * | 9/1976 | Crall | 114/106 |
| 4,080,917 | * | 3/1978 | Alter et al. | 114/106 |
| 4,248,281 | * | 2/1981 | Hood | 114/106 |
| 4,480,570 | * | 11/1984 | Rosenfield et al. | 114/106 |
| 4,723,499 | * | 2/1988 | Furgang | 114/106 |
| 4,821,664 | * | 4/1989 | Dahmen | 114/107 |
| 5,619,946 | * | 4/1997 | Wallasch | 114/106 |
| 5,878,683 | * | 3/1999 | Kyle | 114/106 |
| 5,890,447 | * | 4/1999 | Bernson | 114/106 |

FOREIGN PATENT DOCUMENTS

| | | | | |
|---|---|---|---|---|
| 2815719 | * | 10/1979 | (DE) | 114/106 |
| 2601324 | * | 1/1988 | (FR) | 114/106 |
| 1407662 | * | 9/1975 | (GB) | 114/107 |
| 2060090 | * | 4/1981 | (GB) | 114/106 |

* cited by examiner

*Primary Examiner*—S. Joseph Morano
*Assistant Examiner*—Ajay Vasudeva
(74) *Attorney, Agent, or Firm*—Dougherty & Troxell

(57) ABSTRACT

A roller furling apparatus is disclosed having a bearing device configured to be rotatably fixed relative to a stay, a furler housing having an opening into which the stay extends and an end portion rotatably mounted on the bearing device such that the furler housing is rotatable with respect to the bearing device and the stay. The furling device further has a drive portion about which a line is coiled so as to rotate the furler housing and drum flanges mounted on the furler housing so as to rotate with the housing, the flanges being spaced apart and located at opposite ends of the drive portion. A line guard is slidably mounted on, and extends between the spaced apart drum flanges, the line guard extending around a major portion of the peripheries of the drum flanges. At least one support member is connected to the line guard and to the bearing device to hold the line guard in a stationary position as the furler housing and drum flanges rotate. At least one of the drum flanges is split and has first and second drum flange portions releasably attached together by a releasable attachment device consisting of an engagement recess formed in one of the drum flange portions and a resiliently movable arm on the other of the drum flange portions, the movable arm having a protrusion releasably engaging the engagement recess.

19 Claims, 9 Drawing Sheets

FURLING DRUM WITH FIXED GUARD

FIELD OF THE INVENTION

This invention relates to a roller furling apparatus for installation on a stay of a sailboat and more particularly to a roller furling drum having a fixed line guard and a split furling drum.

BACKGROUND OF THE INVENTION

Roller furling systems, such as disclosed in the U.S. Pat. No. of Crall (3,789,790) have been in use for many years. Such systems typically include a sleeve or torsion element which surrounds a forward stay on a sailboat. The systems also typically include means such as a jib sail spool which sits on and rotates about a bearing for winding and unwinding i.e., furling or unfurling a sail. Means are also provided for rotating the jib sail spool, such as a drum or spool about which a furling line is coiled.

More recent developments such as those disclosed by Hood (U.S. Pat. No. 4,248,281) and Dahmen (U.S. Pat. No. 4,821,664) have facilitated sail changes and led to an increased demand for roller furling devices.

Nevertheless, there are a number of shortcomings associated with the prior art roller furlers and it is believed that there may be a large commercial demand for a roller furler which overcomes those shortcomings. For example, roller furlers are typically installed over an existing headstay and require some disassembly of the standing rigging. For this reason, a number of sailors may be intimidated by the installation and then turn to a professional which adds to the cost of the roller furler. Some sailors may also be intimidated by the cost of a typical roller furler and would be attracted to a less expensive device.

It has now been found that a roller furling apparatus in accordance with the present invention overcomes the aforementioned shortcomings and offers a number of advantages over prior art furlers. For example, roller furlers in accordance with the present invention are designed for installation over an existing headstay with a headstay intact and in place. Accordingly, the roller furler can be sold in kit form and be readily installed by relatively unskilled individuals using only readily available tools. In addition, the roller furlers in accordance with the present invention are relatively light in weight and flexible lengthwise so that they can be coiled for packaging and shipment, while, at the same time, providing torsional rigidity after installation. The roller furling apparatus in accordance with the present invention is also durable, inexpensive to manufacturer and presents a pleasing appearance without outward projections which might damage a sail.

A further feature of the present invention resides in a split drum or jib-sail spool and a fixed line guard which can be installed over an existing headstay with the headstay intact and in place. The split drum and fixed line guard may also be applicable to more conventional furling apparatus which is installed after release of the headstay from the sailboat.

SUMMARY OF THE INVENTION

A roller furling apparatus is disclosed for use on a sailboat having a stay, the roller furling apparatus having a bearing device configured to be rotatably fixed relative to the stay, a furler housing having an opening into which the stay extends, the furler housing having an end portion rotatably mounted on the bearing device such that the furler housing is rotatable with respect to the bearing device and the stay.

The furling device further has a drive portion about which a line is coiled so as to rotate the furler housing. Generally circular drum flanges are mounted on the furler housing so as to rotate with the housing, the flanges being spaced apart and located at opposite ends of the drive portion of the furler housing. A line guard is slidably mounted on, and extends between the spaced apart drum flanges, the line guard extending around a major portion of the peripheries of the drum flanges. At least one support member is connected to the line guard and to the bearing device so as to hold the line guard in a stationary position as the furler housing and drum flanges rotate.

The invention also encompasses a roller furling apparatus having a bearing device rotatably fixed relative to the stay, a furler housing having an opening into which the stay extends and an end portion rotatably mounted on the bearing device such that the furler housing is rotatable with respect to the bearing device and the stay, the furler housing further having a drive portion. Drum flanges are mounted on the furler housing so as to rotate with the furler housing and are located at opposite ends of the drive portion of the furler housing. At least one of the drum flanges is split and has first and second drum flange portions releasably attached together by a releasable attachment device. The releasable attachment device consists of an engagement recess formed in one of the drum flange portions and a resiliently movable arm on the other of the drum flange portions, the movable arm having a protrusion releasably engaging the engagement recess.

The bearing device may be attached to the stay, or may be attached to a stem head mounted on the sailboat. The bearing device is configured to be attachable to various types of stem heads.

DETAILED DESCRIPTION OF THE PREFERRED EMBODIMENTS

Figure 1:
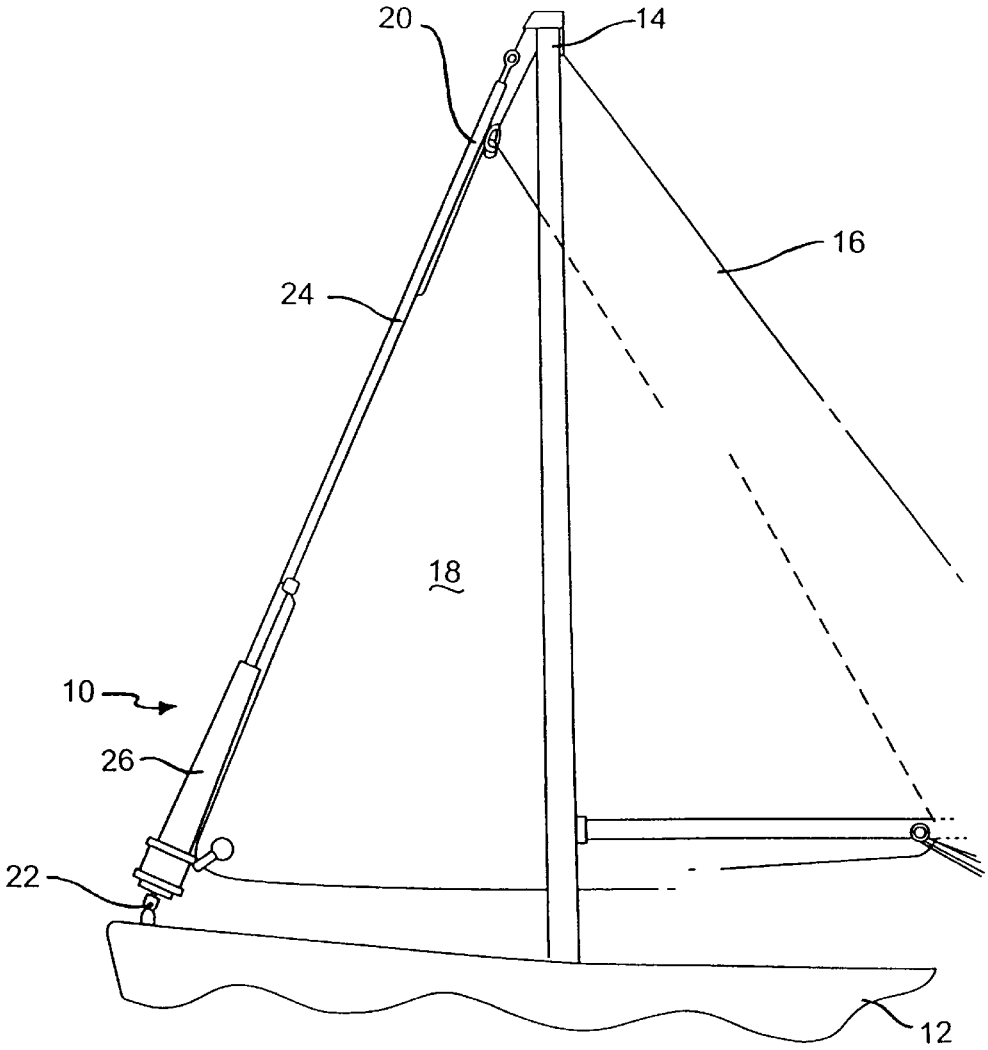
FIG. 1 is a partial side view of a sailboat having a roller furling apparatus according to the present invention.

As illustrated best in FIG. 1, the roller furling apparatus 10 according to the present invention is utilized on a sailboat having a hull portion 12 and a mast 14 extending upwardly from the hull portion. The mast 14 may support a main sail 16 and a stay 20 to which is attached the jib sail 18. The stay 20 extends from a top portion of the mast 14 and is attached to stem head 22 mounted adjacent to the bow portion of the hull 12.

A furling element 24 is attached around the stay 20 and has the jib sail 18 attached thereto. A lower portion of the furling element 24 is clamped into a furler housing 26 which, in turn, is rotatably supported by a bearing device attached to the stay 20 or stem head 22. Rotation of the furler housing 26 causes rotation of the furling element 24 about the stay 20 to furl and unfurl the jib sail 18.

Figure 2:
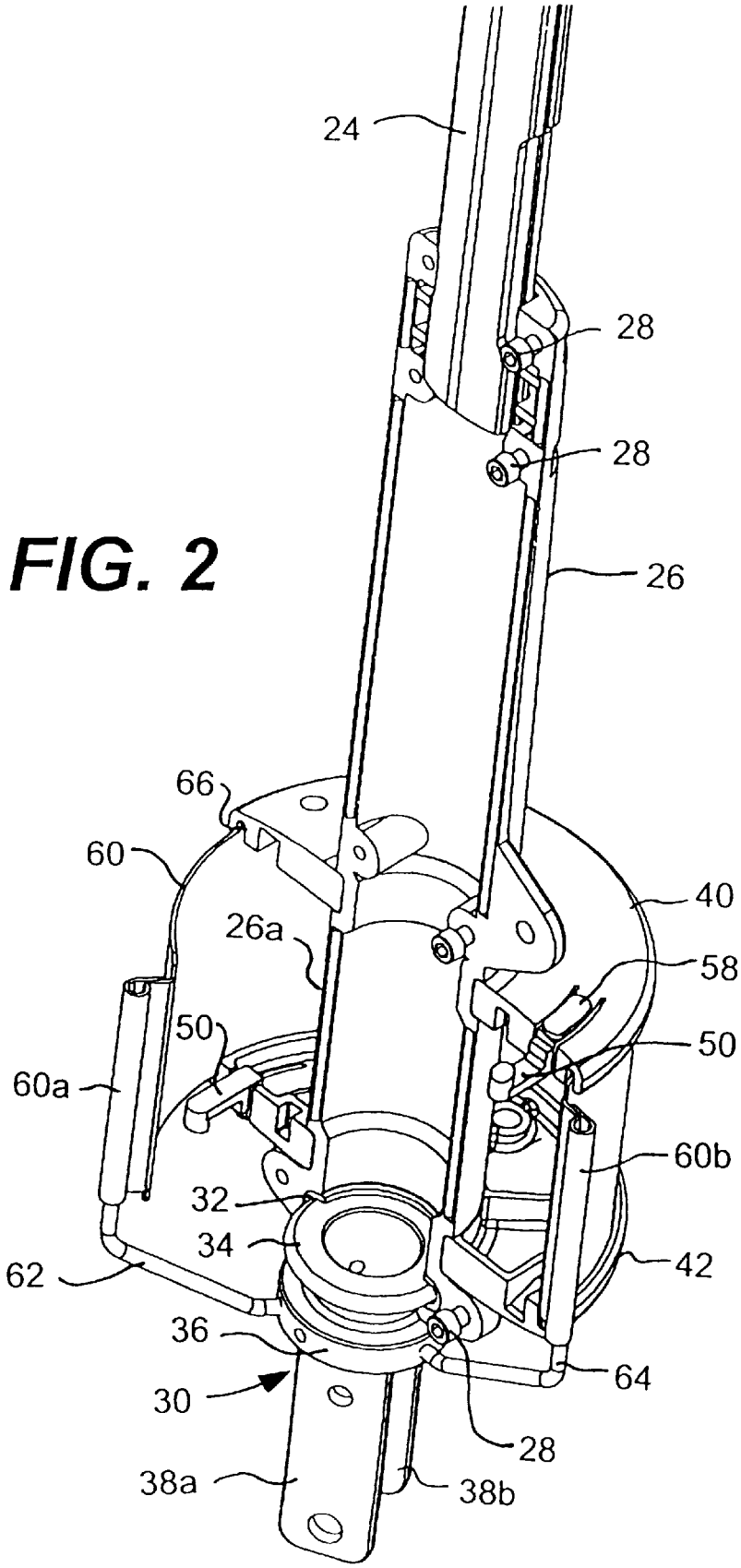
FIG. 2 is a perspective, cross-sectional view of a first embodiment of the roller furling apparatus according to the present invention.
Figure 3:
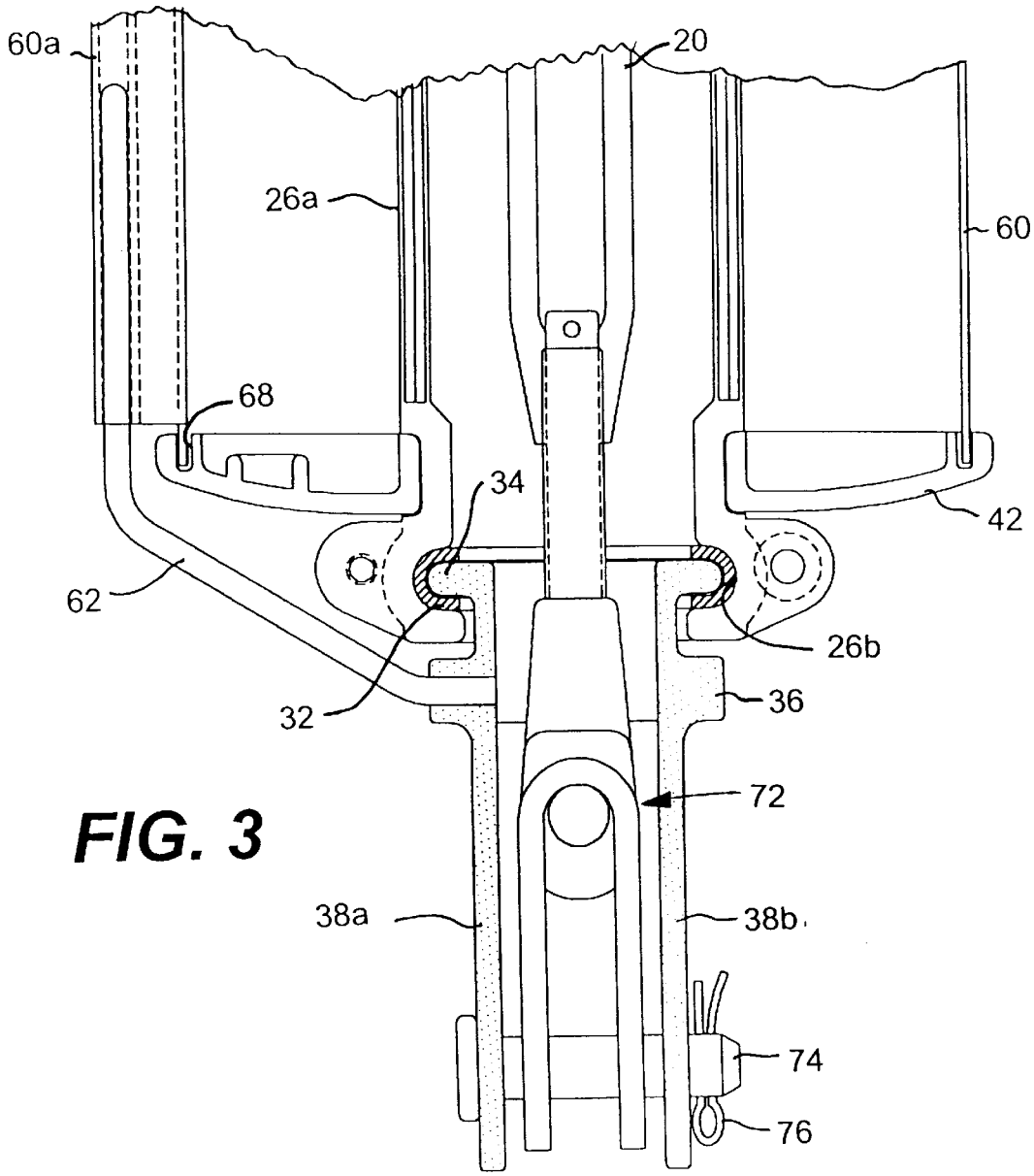
FIG. 3 is a partial, cross-sectional view of the roller furling apparatus illustrated in FIG. 2.

A first embodiment of the roller furling apparatus according to the present invention is illustrated in FIGS. 2–12. As best seen in FIGS. 2 and 3, the furler housing 26 comprises two housing portions divided in a plane extending along the longitudinal centerline to enable the furler housing 26 to be attached around the stay 20 without the necessity of detaching the stay 20 from either the mast 14 or the stem head 22. Although only one housing portion is illustrated in FIG. 2, it is to be understood that the other housing portion is a mirror image of the housing portion illustrated. The two housing portions are retained together by bolts or screws 28. The upper portion of the furler housing 26 clamps around the lower portion of the furling element 24 such that rotation of the furler housing 26 causes rotation of furling element 24 about stay 20.

Drive portion 26*a* is located at a lower portion of the furler housing 26. In known fashion, a line is coiled around the drive portion 26*a* such that, when the line is pulled, the furler housing 26 rotates.

Bearing device 30 rotatably supports the lower end portion of the furler housing 26. Since it is envisioned that furler housing 26 may be made of a plastic or other non-metallic material, a bearing insert 32 is mounted within the bearing recesses 26*b* formed in the lower portion of the furler housing 26. The bearing insert 32 has a generally annular configuration with a U-shaped cross-section and is slidably engaged by bearing flange 34 of the bearing device 30. As can be seen, the bearing flange 34 and the bearing insert 32 are able to provide both rotational and longitudinal support to the furler housing 26.

Bearing device 30 has collar 36 located below the bearing flange 34, and mounting legs 38*a* and 38*b* extending downwardly from the collar 36.

Drum flanges 40 and 42 are mounted on the housing 26 so as to rotate therewith. The drum flanges are spaced apart in a longitudinal direction and are attached to the furler housing 26 at opposite ends of the drive portion 26*a*. It is envisioned that at least one of the drum flanges has a split construction comprising a plurality of drum flange portions which are releasably held together so as to facilitate attachment of the furler housing to the stay and to facilitate access to the drive portion 26*a*.

Figure 4:
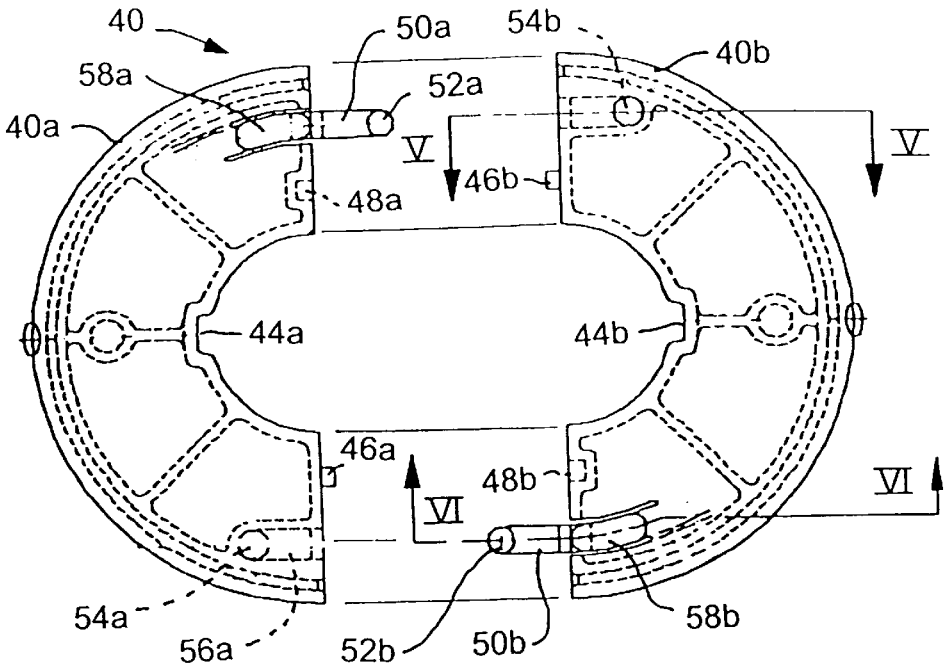
FIG. 4 is an exploded top view of a drum flange according to the present invention.
Figure 5:
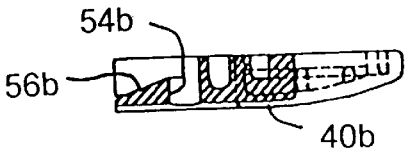
FIG. 5 is a cross-sectional view taken along the line V—V in FIG. 4.
Figure 6:
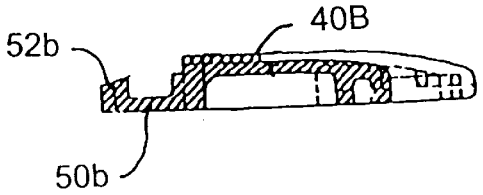
FIG. 6 is a cross-sectional view taken along the line VI—VI in FIG. 4.

Such split construction is illustrated in FIGS. 4–6. Although these figures illustrate the drum flange 40 as comprising the split construction, it is envisioned that the lower drum flange 42 may also have such split construction. Since the split construction is identical for both drum flanges 40 and 42, only the construction of drum flange 40 will be described, it being understood that drum flange 42 may have an identical construction.

Each of the drum flange portions 40*a* and 40*b* has a central recess 44*a* and 44*b* which engages the furler housing 26. The central recesses 44*a* and 44*b* may be generally semi-circular and include drive notches which engage protuberances on the furler housing 26 to ensure that the drum flange 40 rotates with the furler housing 26. The engagement of posts 46*a* and 46*b* with corresponding recesses 48*a* and 48*b* ensure that the drum flange portions 40*a* and 40*b* are properly oriented next to each other. At least one of the drum flange portions has a resilient arm 50 extending therefrom. As illustrated in FIG. 4, both of the drum flange portions 40*a* and 40*b* have resilient arms 50*a* and 50*b* extending therefrom. The resilient arms have distal ends with protrusions 52*a*, 52*b* extending upwardly therefrom. The protrusions 52*a*, 52*b* have upwardly facing angled or tapered surfaces thereon. The protrusions engage engagement recesses 54*a*, 54*b* to releasably hold the drum flange portions 40*a* and 40*b* together. As best seen in FIGS. 4 and 5, angled surfaces 56*a*, 56*b* are located adjacent to the engagement recesses 54*a*, 54*b* such that, as the drum flange portions 40*a* and 40*b* are pushed together, the angled surfaces of the protrusions 52*a*, 52*b* slide along the angled surfaces 56*a* and 56*b* so as to resiliently deform the movable arms 50*a* and 50*b*. When the protrusions 52*a*, 52*b* are aligned with the engagement recesses 54*a*, 54*b*, the resiliency of the arms urges the protrusions 52*a*, 52*b* into engagement with the engagement recesses 54*a*, 54*b*.

The movable arms 50*a*, 50*b* may be integrally formed with the respective drum flange portion 40*a*, 40*b*, and may have press pad portions 58*a*, 58*b* located on an outer surface. The press pad portions facilitate the application of a manual force to the movable arms so as to disengage the protrusions 52*a*, 52*b* from their respective engagement recesses 54*a*, 54*b* to thereby enable the drum flange portions 40*a*, 40*b* to be separated.

Figure 7:
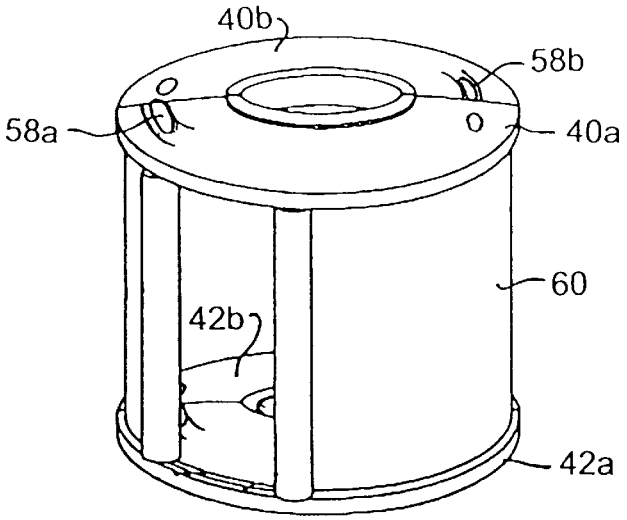
FIG. 7 is a perspective view of the assembled drum flanges and line guard utilized with the present invention.
Figure 8:
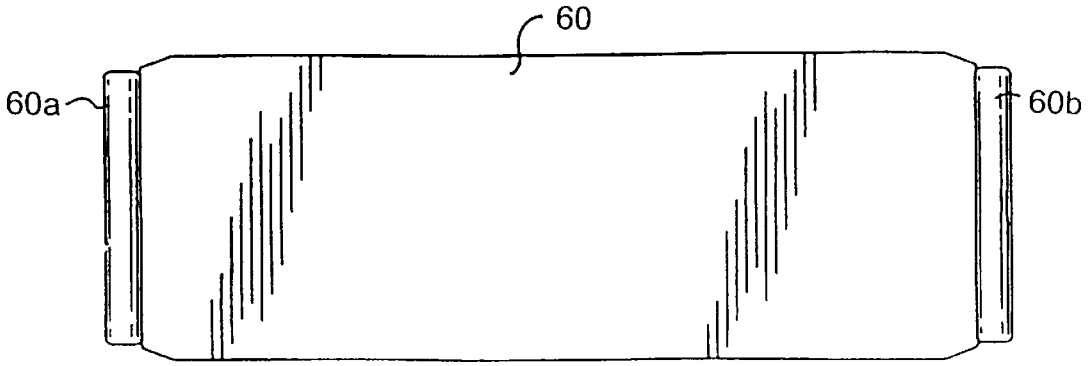
FIG. 8 is a plan view of the line guard illustrated in FIG. 7.

A line guard 60 is illustrated in FIGS. 7 and 8, and has opposite end portions 60*a*, 60*b*, each of which are formed as cylinders bounding an opening. The line guard 60 is rotatably mounted to the drum flanges 40 and 42 which, on their facing surfaces, have generally circular recesses 66 and 68 (see FIGS. 2 and 3). The line guard 60 extends around a major portion of the peripheries of the drum flanges 40 and 42.

Support arms 62 and 64 each have a first end which may releasably engage the cylindrical openings formed in the end portions 60*a* and 60*b* of the line guard 60, and a second end engaging the collar 36 of the bearing device 30, as best illustrated in FIGS. 2 and 3. Since the bearing device 30 is non-rotatable relative to the stay 20, the arms 62 and 64, via their engagement with the end portions 60*a* and 60*b*, will hold the line guard 60 in a stationary position as the furler housing 26, along with the drum flanges 40 and 42, rotate. The opening between the opposite ends 60*a* and 60*b* of the line guard 60 generally faces toward the rear of the sailboat when the furler housing is mounted at the bow of the sailboat. Since the line guard 60 extends around a major portion of the peripheries of the drum flanges 40 and 42, it effectively protects the drive portion 26*a* from water spray, etc., but at the same time does not interfere with the rotation of the furler housing 26 and the drum flanges 40, 42.

Figure 9:
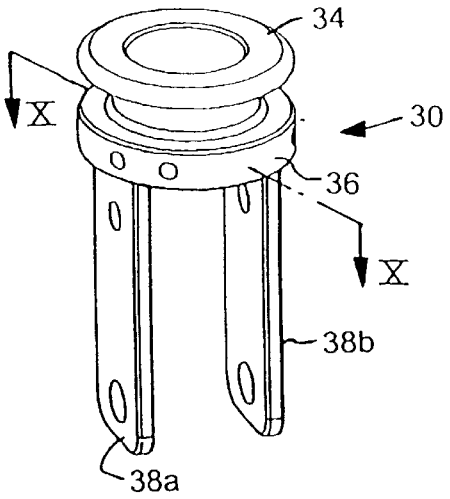
FIG. 9 is a perspective view of a first embodiment of a bearing device utilized in the roller furling apparatus according to the present invention.
Figure 11:
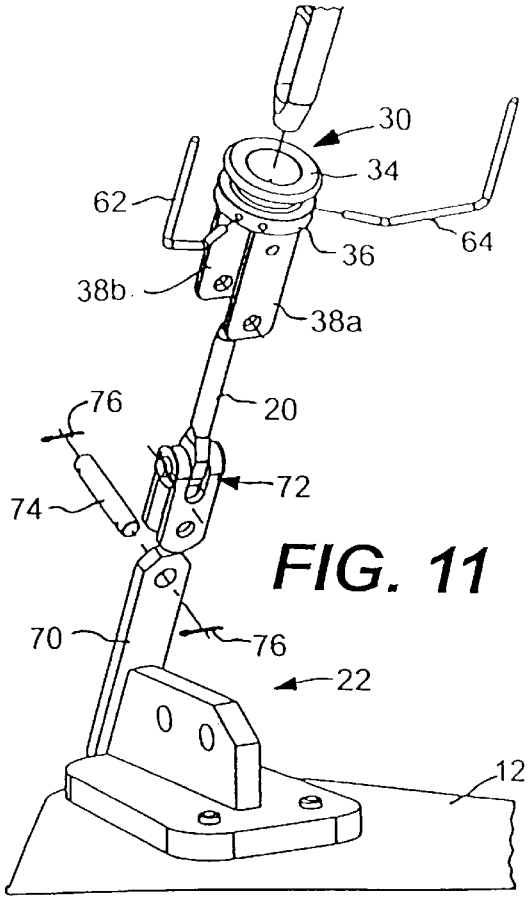
FIG. 11 is a partial, perspective view illustrating the attachment of the bearing device to a first type of stem head.
Figure 12:
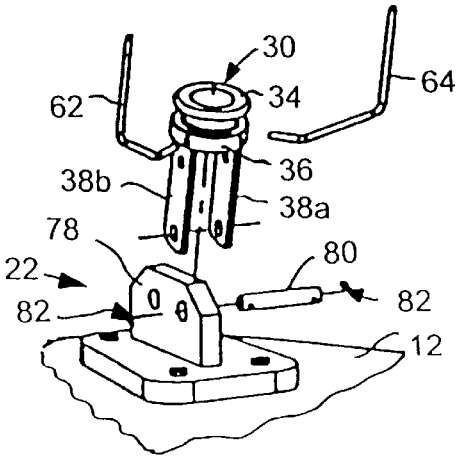
FIG. 12 is a partial, perspective view illustrating the attachment of the bearing device to a second type of stem head.
Figure 10:
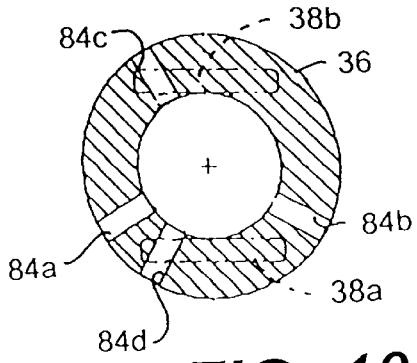
FIG. 10 is a cross-sectional view taken along the line X—X in FIG. 9.

The bearing device 30 illustrated in FIGS. 9 and 10 is attachable to various types of stem heads 22. As best illustrated in FIG. 11, a first type of stem head 22 has an attaching flange 70 which extends generally transversely to the sailboat's longitudinal centerline. With this type of stem head, the attaching legs 38*a* and 38*b* are oriented as illustrated in FIG. 12 such that they are located on opposite sides of the attachment flange 70 and over the attachment clevis 72 attaching the stay 20 to the stem head 22. Pin 74 extends through the openings in the attaching legs 38*a* and 38*b,* as well as through the attachment clevis 72 to attach these elements to the stem head 22. The pin 74 may be retained in position by cotter pins 76, or the like.

A different type of stem head 22 is illustrated in FIG. 12 wherein the attaching flange 78 extends generally along the longitudinal centerline of the sailboat. With this stem head, the attaching legs 38*a* and 38*b* of the bearing device 30 are oriented so as to extend on opposite sides of the attaching flange 78 and the bearing device 30 is attached thereto by pin 80 which is retained in position by cotter pins 82, or the like. As can be seen in FIGS. 11 and 12, the orientations of the bearing device between the two types of stem heads 22 differs by approximately 90 degrees.

In order to accommodate the various types of stem heads 22, while maintaining the desired orientation of the line guard 60, the collar 36 of the bearing device 30 has a plurality of generally radial holes, illustrated best in FIG. 10 at 84*a,* 84*b,* 84*c,* and 84*d.* When the bearing device is oriented as illustrated in FIG. 11, the support arms 62 and 64 are inserted into holes 84*a* and 84*b,* respectively so as to fix the line guard 60 in an orientation wherein the opening between the opposite ends 60*a* and 60*b* faces generally towards the stern of the sailboat. With the orientation illustrated in FIG. 12, the line guard 60 is maintained in the desired orientation by inserting the support arms 62 and 64 into openings 84*c* and 84*d,* respectively. The included angle between the centerlines of openings 84*a* and 84*b* may be on the order of 120 degrees, with the same included angle being between the centerlines of openings 84*c* and 84*d.* Quite obviously, other values of this included angle may be utilized without exceeding the scope of this invention.

Figure 13:
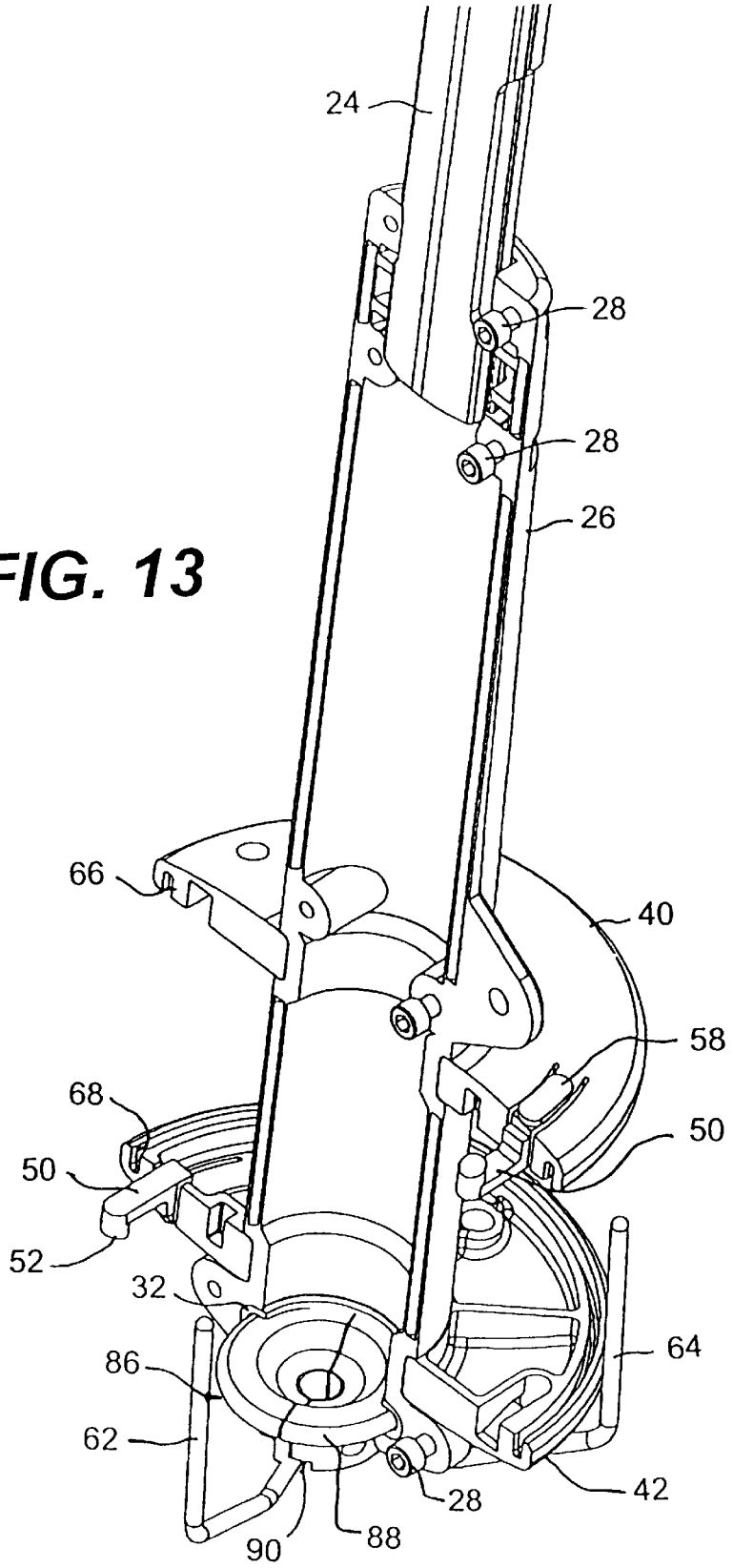
FIG. 13 is a cross-sectional, perspective view of a second embodiment of the roller furling apparatus according to the present invention.
Figure 14:
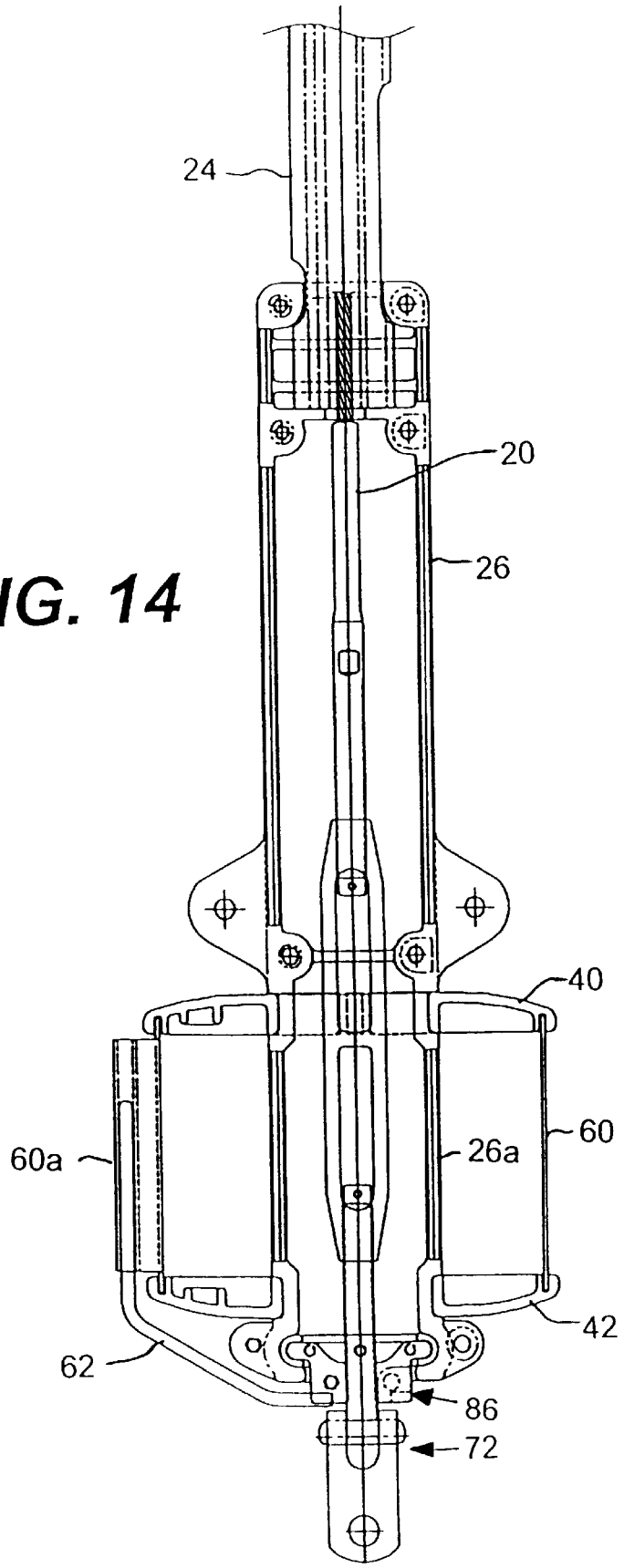
FIG. 14 is a cross-sectional view of the roller furling apparatus illustrated in FIG. 13.
Figure 15:
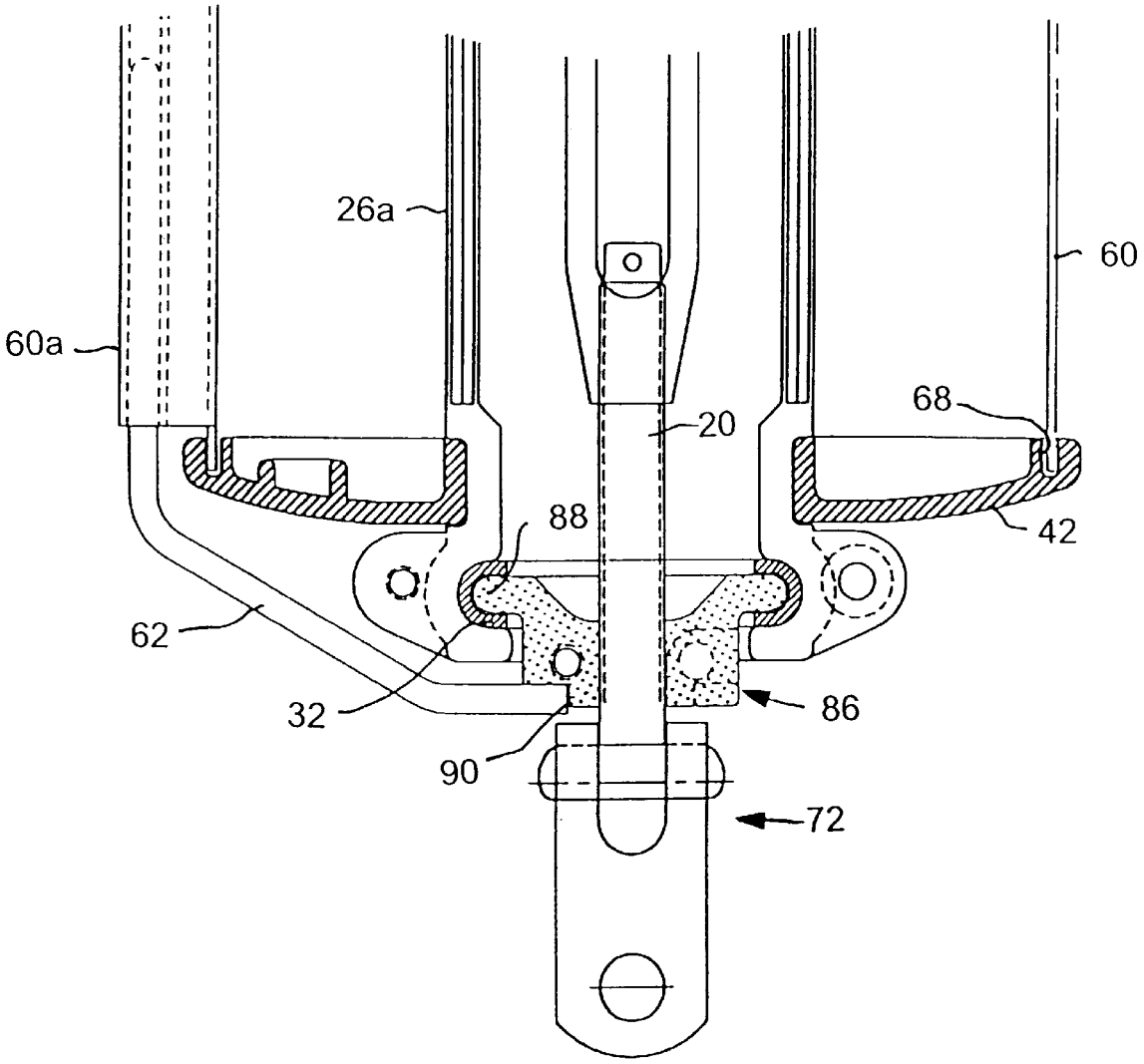
FIG. 15 is a partial, cross-sectional view of the roller furling apparatus illustrated in FIG. 13.

A second embodiment of the invention is illustrated in FIGS. 13–15. In this embodiment, the functions and structures of the furling element 24, the furler housing 26, the drum flanges 40 and 42, and the attaching devices between the drum flange portions of the drum flanges 40 and 42 are identical to the previously described embodiment. In this embodiment, only the bearing device 86 differs structurally from the bearing device 30. Bearing device 86 comprises bearing flange 88 which slidably engages the bearing insert 32 mounted on the lower portion of the furler housing 26 such that the furler housing 26 is rotatable with respect to the bearing device 86 which is rotatably fixed relative to the stay 20. In this embodiment, bearing device 86 does not have attaching legs and the support arms 62 and 64 are attached to a lower portion 90 of the bearing 86 such as by welding or the like. The bearing device 86 may be fixedly attached to the stay 20 or may be otherwise attached to the stem head 22 so as to remain rotatably fixed relative to the stay 20. As in the previous embodiment, the ends of arms 62 and 64 engage openings bounded by the generally cylindrical end portions 60*a* and 60*b* of the line guard 60 in order to hold the line guard 60 in a fixed position as the furler housing 26 rotates.

While the invention has been defined in accordance with its preferred embodiments, it should be recognized that changes and modifications may be made without departing from the scope of the appended claims.

What is claimed is:

1. A roller furling apparatus for a sailboat having a stay and comprising:

a) a bearing device configured to be rotatably fixed relative to the stay;

b) a furler housing having an opening into which the stay extends, the furler housing having an end portion rotatably mounted on the bearing device such that the furler housing is rotatable with respect to the stay and the bearing device, the furler housing further having a drive portion;

c) first and second drum flanges mounted on the furler housing so as to rotate therewith, the first and second drum flanges being spaced apart and located at opposite ends of the drive portion of the furler housing;

d) a line guard slidably mounted on and extending between the first and second spaced apart drum flanges, the line guard extending around a major portion of peripheries of the first and second drum flanges; and, e) at least one support member connected to the line guard and to the bearing device whereby the line guard remains stationary when the furler housing and drum flanges rotate.

2. The roller furler of claim 1, wherein the furler housing comprises an elongated housing in which the opening extends through the housing in a generally longitudinal direction.

3. The roller furler of claim 1, wherein at least one of the first and second drum flanges comprises a split drum flange having first and second drum flange portions.

4. The roller furler of claim 3, wherein the first and second drum flange portions further comprise at least one releasable attachment whereby the drum flange portions are releasably attached together.

5. The roller furler of claim 4, wherein the at least one releasable attachment comprises:

a) an engagement recess formed in one of the first and second drum flange portions; and, b) a movable arm on the other of the first and second drum flange portions, the movable arm having a protrusion releasably engaging the engagement recess.

6. The roller furler of claim 5, wherein the movable arm is formed integrally with the associated drum flange portion.

7. The roller furler of claim 6, wherein the movable arm is resilient and is biased to a position wherein the protrusion engages the engagement recess.

8. The roller furler of claim 5, wherein the movable arm further comprises a press pad portion located such that a force applied to the press pad portion will move the movable arm to disengage the protrusion from the engagement means.

9. The roller furler of claim 5, wherein the protrusion on the movable arm has an angled engaging surface.

10. The roller furler of claim 1, wherein the at least one support member comprises at least one support arm having a first end connected to the line guard and a second end connected to the bearing device.

11. The roller furler of claim 10, wherein the second end of the at least one support arm is removably connected to the bearing device.

12. The roller furler of claim 10, wherein the first end of the support arm is removably connected to the line guard.

13. The roller furler of claim 1 in which said at least one support member comprises two support arms, each having a first end connected to the line guard and a second end connected to the bearing device.

14. The roller furler of claim 10, further comprising connection means to connect the second end of the at least one support arm to the bearing device in a plurality of positions.

15. A roller furling apparatus for a sailboat having a stay and comprising:

a) a bearing device configured to be rotatably fixed relative to the stay;

b) a furler housing having an opening into which the stay extends, the furler housing having an end portion rotatably mounted on the bearing device such that the furler housing is rotatable with respect to the stay and the bearing device, the furler housing further having a drive portion; and, c) first and second drum flanges mounted on the furler housing so as to rotate therewith, the first and second flanges being spaced apart and located at opposite ends of the drive portion of the furler housing, at least one of the first and second drum flanges comprising first and second drum flange portions releasably attached together by at least one releasable attachment comprising:

i) an engagement recess formed in one of the first and second drum flange portions; and, ii) a movable arm on the other of the first and second drum flange portions, the movable arm having a protrusion releasably engaging the engagement recess.

16. The roller furler of claim 15, wherein the movable arm is formed integrally with the associated drum flange portion.

17. The roller furler of claim 16, wherein the movable arm is resilient and is biased to a position wherein the protrusion engages the engagement recess.

18. The roller furler of claim 15, wherein the movable arm further comprises a press pad portion located such that a force applied to the press pad portion will move the arm to disengage the protrusion from the engagement means.

19. The roller furler of claim 15, wherein the protrusion on the movable arm has an angled engaging surface.

* * * * *